United States Patent [19]

Dimarco et al.

[11] Patent Number: 5,016,706

[45] Date of Patent: May 21, 1991

[54] HEAT EXCHANGER TUBE SUPPORT

[75] Inventors: Ben P. Dimarco; Ralph J. Tolone, both of Clay; Lester N. Miller, East Syracuse, all of N.Y.

[73] Assignee: Carrier Corporation, Syracuse, N.Y.

[21] Appl. No.: 428,679

[22] Filed: Oct. 30, 1989

[51] Int. Cl.[5] ..... F28F 9/00

[52] U.S. Cl. ..... 165/162; 165/69

[58] Field of Search ..... 165/162, 69; 248/62, 248/68.1

[56] References Cited

U.S. PATENT DOCUMENTS

| | | | |
|---|---|---|---|
| 1,336,388 | 4/1920 | Youngberg | 248/68.1 |
| 1,780,188 | 11/1930 | Hildebrandt et al. | 248/68.1 |
| 2,003,159 | 5/1935 | Taylor | 248/62 |
| 2,198,529 | 4/1940 | Fields | 165/162 |
| 2,342,958 | 2/1944 | Morehouse | 248/68 |
| 3,007,679 | 11/1961 | Byerley et al. | 165/162 |
| 3,233,851 | 2/1966 | Lemieux et al. | 248/68 |
| 3,544,049 | 12/1970 | Brown et al. | 248/68 |
| 3,637,008 | 1/1972 | Michel et al. | 165/69 |
| 3,720,259 | 3/1973 | Fritz et al. | 165/162 |
| 4,231,421 | 11/1980 | Eaton et al. | 165/68 |
| 4,421,070 | 12/1983 | Sullivan | 165/162 |
| 4,433,721 | 2/1984 | Biaggi | 165/162 |
| 4,465,125 | 8/1984 | Haas | 165/76 |
| 4,492,269 | 1/1985 | Jennings et al. | 165/172 |
| 4,657,069 | 4/1987 | Easton | 165/76 |
| 4,691,764 | 9/1987 | Dürst | 165/68 |
| 4,799,641 | 1/1989 | Koreski | 248/68.1 |

*Primary Examiner*—Stephen M. Hepperle
*Assistant Examiner*—L. R. Leo
*Attorney, Agent, or Firm*—Dana F. Bigelow

[57] ABSTRACT

Support for the heat exchanger tubes of a gas-fired, year round air conditioning unit are provided by a pair of interlocking, wire frame elements that sandwich the tubes therebetween and are, in turn, securely attached to the frame structure. The two elements are biasingly interlocked in a safety pin fashion, with the combination providing adequate support while, at the same time, offering little resistance to the flow of air over the supported tubes.

13 Claims, 2 Drawing Sheets

HEAT EXCHANGER TUBE SUPPORT

BACKGROUND OF THE INVENTION

This invention relates generally to hot air heating systems and, more particularly, to a support structure for a tubular heat exchanger element therein.

In rooftop air conditioning systems which have been traditionally used to condition the air being provided to the building by a way of ducts, the air is cooled during the warmer seasons and heated in the cooler seasons. In such systems, heating is provided by way of gas burners incorporated into the unit such that the rooftop unit can provide the full heating and cooling needs for the building. Such a unit is called a year-round, packaged, air conditioning system.

Where gas is used to provide the supplementary heat in such a system, the heat exchanger apparatus by which the heat is transferred from the gas fired burners to the indoor air stream comprises a plurality of multipath tubes disposed in parallel relationship in the indoor air stream. The tubes are preferably suspended in a predetermined location within the indoor air stream such that the heat transfer efficiency is optimized. It is therefore necessary to provide proper support structure for the installation, placement and support of these tubes within the unit. In order to adequately perform its function, the supporting structure should have the strength and integrity to not only prevent movement and/or vibration of the tubes during operation, but should also be capable of maintaining the proper alignment during shipping and installation of the system. On the other hand, since the support structure must necessarily be placed within the indoor air stream, the cross sectional area of the support structure is preferably minimized so as to reduce the resistance that is offered to the flow of the air stream.

Another consideration that is given to the heat exchanger support structures is that of ease of installation into the system. One approach has been that of employing a sheet metal plate with a plurality of holes formed therein for receiving the tubes of the heat exchanger. These tubes are individually laced into the opening of the plates, and then the plates, with the installed tubes, must be fastened within the housing by way of welding or the like. Such an assembly process is difficult and time consuming. Further, such a plate tends to offer substantial resistance to the flow of air across the heat exchanger tubes.

It is therefore an object of the present invention to provide an improved heat exchanger support apparatus.

Yet another object of the present invention is the provision for a heat exchanger support structure that is rigid and sturdy, but one which offers little resistance to air flow across the tubes.

Still another object of the present invention is the provision for installing heat exchanger tubes into a heating unit in an efficient and simple assembly process.

Yet another object of the present invention is the provision for a heat exchanger support structure that is economical and practical to make and yet effective and reliable in use.

These objects and other features and advantages become more readily apparent upon reference to the following description when taken into conjunction with the appended drawings.

SUMMARY OF THE INVENTION

Briefly, in accordance with one aspect of the invention, the heat exchanger tubes of a gas fired heating system are supported by way of wire-formed brackets on either side thereof, one bracket being rigidly secured to and supported by the system framework and the other being movably spring loaded in place, in safety pin fashion, to rigidly secure the heat exchanger tubes therebetween. The wire formed brackets provide positive placement and positional stability while offering little resistance to the flow of indoor air there over.

In accordance with another aspect of the invention, the brackets are wavy in form to correspond to the shape of the tubes that are disposed in parallel relationship therebetween.

By yet another aspect of the invention, the moveable bracket is secured to the fixed bracket by way of hooks on either end of the movable bracket, with one hook being secured in a slot at one end of the fixed bracket and the other hook being secured in a slot at the other end of said fixed bracket by overcoming the spring bias of the wire formed piece to thereby maintain the heat exchanger tubes sandwiched therebetween in a tightly installed condition.

In the drawings as hereinafter, described, a preferred embodiment is depicted; however, various other modifications and alternate constructions can be made thereto without departing from the true spirit and scope of the invention.

DESCRIPTION OF THE PREFERRED EMBODIMENT

Figure 1:
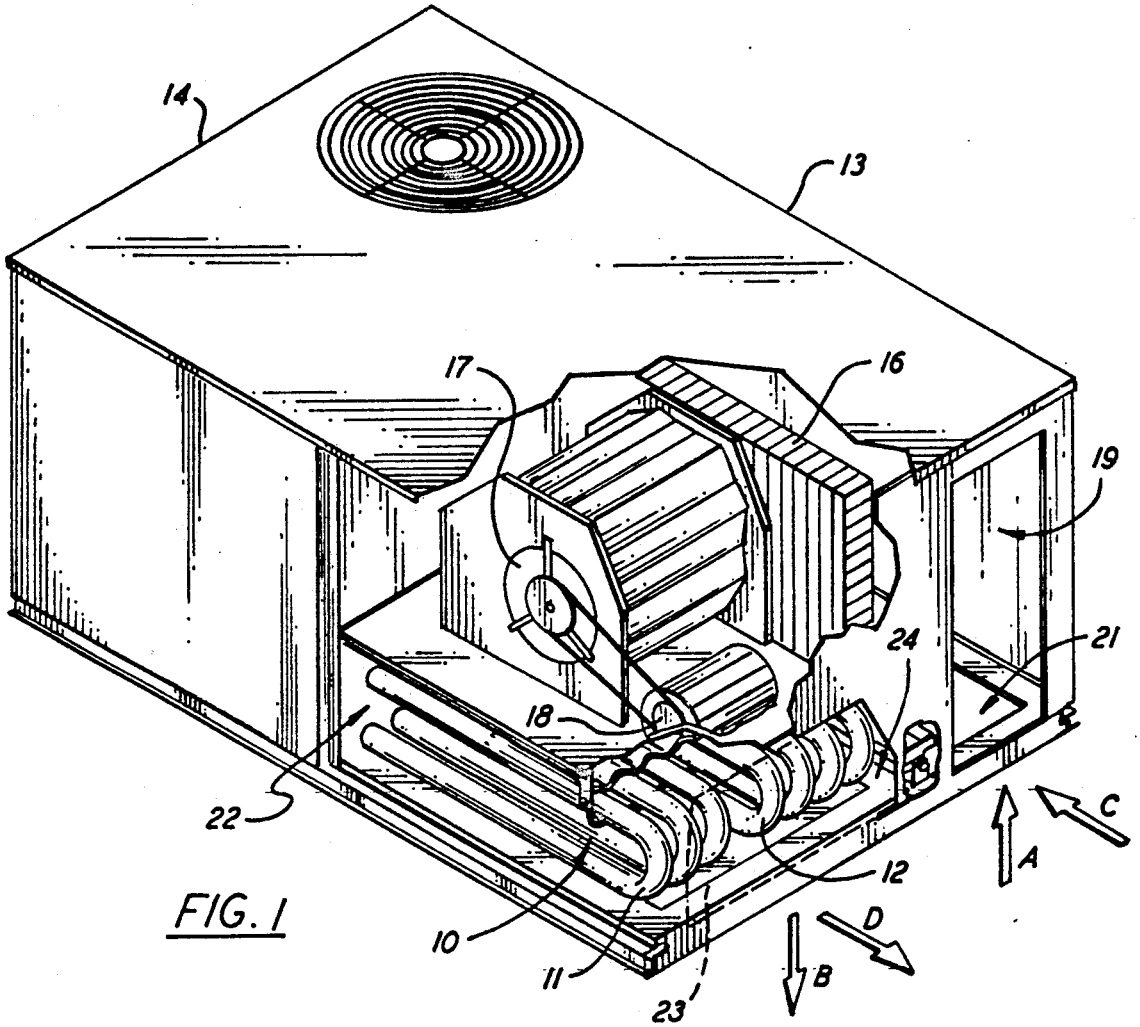
FIG. 1 is a perspective view of a rooftop, year-round unit with the present invention incorporated therein.

Referring now to FIG. 1, the invention is shown generally at 10 as installed for the purpose of supporting one end 11 of a plurality of heat exchanger tubes 12 in a year-round, roof top air conditioning unit 13. The unit 13 has a condenser coil (not shown) in one end 14 thereof and an evaporator coil 16 in the other end thereof, with the two being interconnected in a conventional manner to provide a complete refrigeration circuit, with the coil 16 acting as an evaporator coil to cool the air during warmer ambient conditions and as a condenser coil to warm the returned air during cooler ambient conditions. The return air is caused to flow through the coil 16, in a draw-thru manner, by way of a blower 17 which is driven by a motor 18.

The unit shown is a so-called convertible unit which can be used either in the downflow or in the side discharge mode. If in the downflow mode, the opening 19 is covered and the return air flows, in the direction indicated by the arrow A, through the lower opening 21, through the coil 16, through the blower 17, through the heat exchanger chamber 22 and out the lower discharge opening 23 to the space to be heated/cooled as indicated by the arrow B. The side discharge opening 24 is closed off in such a downflow installation In a side discharge installation, the openings 21 and 23 are closed off and the return air enters the opening 19 and, after passing through the heat exchanger chamber 22, exits the side discharge opening 24 to return to the space to be heated/cooled.

During the cooling mode of operation, the heat exchanger tubes 12 are not functional. Similarly where the ambient temperatures are moderate such that the heat pump function of the unit is sufficient to provide the needed warmed air, the heat exchange tubes 12 are inoperable. However, at lower ambient temperatures where it is necessary to add supplementary heat, gas burners (not shown) located near the other ends of the heat exchanger tubes 12 are actuated to heat the air which is caused to flow through the tubes 12 by way of an inducer. The return air is then heated as it flows over the outer surface of the tubes 12, prior to being discharged through the opening 23 or 24.

It will be seen that as the heat exchanger tubes 12 extend out into the heat exchanger chamber 22, there is a need to support their one ends 11, both for preventing movement and dislocation during shipping and installation, as well as from vibratory movement caused by the flow of air thereover during operation. At the same time, it will be understood that, because of the need to flow relatively large volumes of air over the tubes 12, it is desirable to have as little additional structure as possible since any such supporting structure will tend to offer resistance to the flow of air through the chamber 22. The present invention is therefore designed to provide the required support while at the same time offering little resistance to the flow of air over the tubes.

Figure 2:
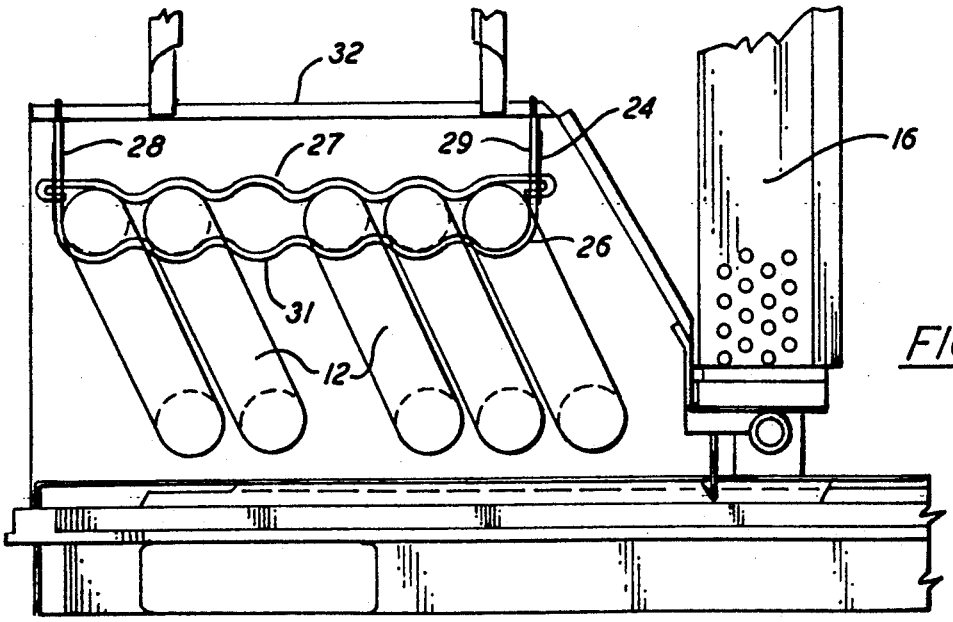
FIG. 2 is a partial end view thereof showing the heat exchanger support apparatus of the present invention.

Referring now to FIG. 2, the support structure of the present invention is indicated generally at 24 and comprises a bottom, or supporting, element 26 and a top, or securing, element 27. The bottom element 26 is generally U-shaped in form with upstanding legs 28 and 29 interconnected by a cross member 31 which is wavy in form so as to register with the individual tubes 12 in a nesting manner. The upstanding legs 28 and 29 are secured by appropriate fasteners or the like, to the platform 32 which forms the upper boundary of the heat exchanger chamber 22. The top element 27 is also wavy in form to accommodate the form of the individual tubes 12 and is attached at its two ends to the upstanding legs 28 and 29 in a manner to be described hereinafter.

Figure 4:
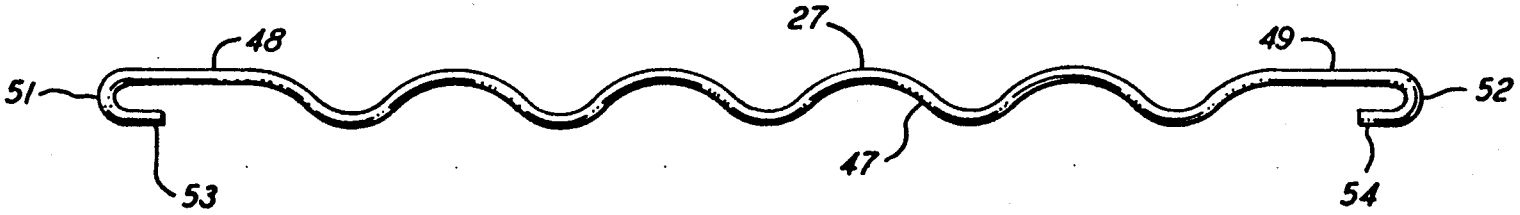
FIG. 4 is a side view of the upper member of the heat exchanger tube support.
Figure 3:
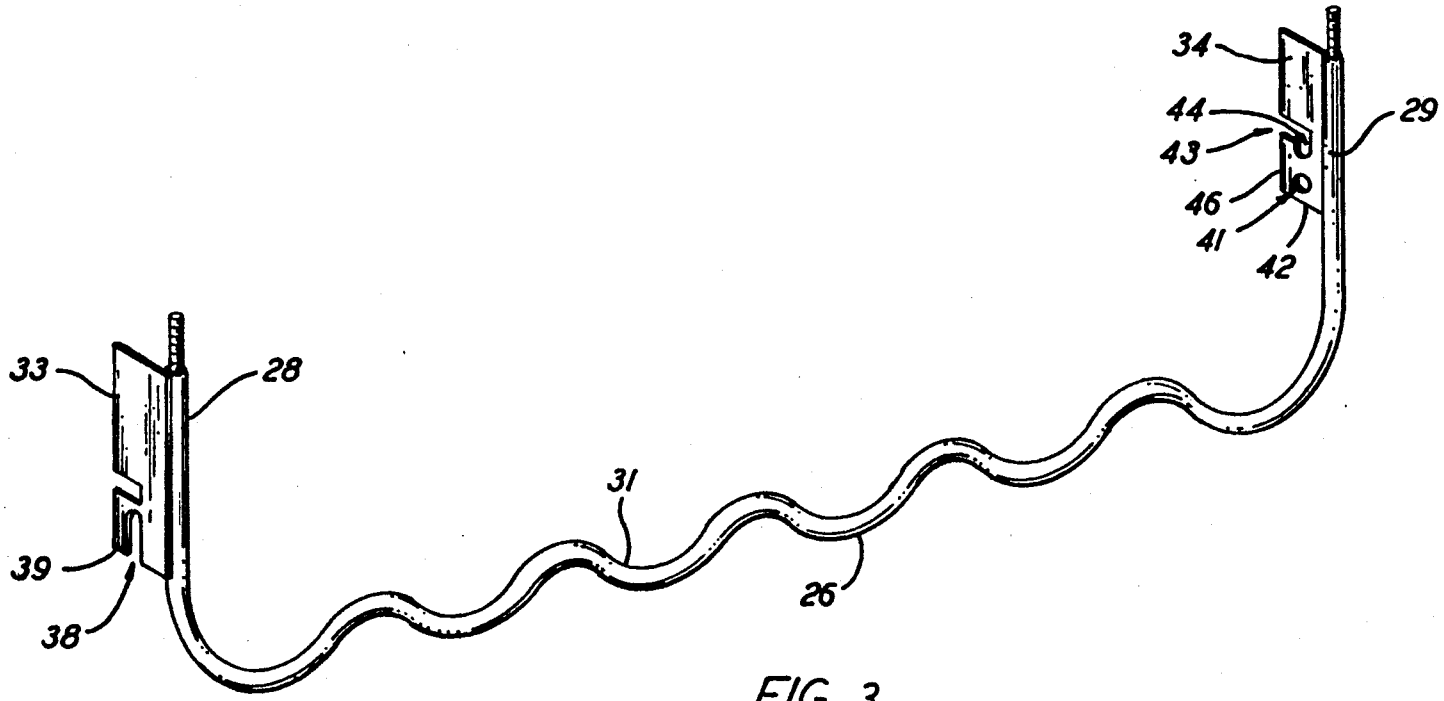
FIG. 3 is a perspective view of the lower member of the heat exchanger tube support.

Referring now to FIGS. 3 and 4, where the bottom and top elements 26 and 27 are shown in more detail, it will be seen that the legs 28 and 29 have corresponding fastener plates 33 and 34, respectively, attached thereto by welding or the like. Fastener plate 33 has an elongate slot 38 formed in a lower edge 39 thereof for securing the top element 27 in the manner to be described.

The fastener plate 34 has a hole 41 formed near its lower edge 42 thereof, and a notch 43 with a small indent 44 formed in its side edge 46 thereof. Again, these are provided for securing the top element 27 thereto.

As will be seen in FIG. 4, the top, or securing element 27 comprises a wavy central portion 47, the straight end portions 48 and 49, and U-shaped hook portions 51 and 52. The U-shaped hook portions 51 and 52 terminate in ends 53 and 54, respectively. Assuming now that the bottom element 26 has been secured in place to the upper platform 32, in a supporting relationship with respect to the heat exchanger tubes 12, the top element 27 is installed as follows. The U-shaped hook portion 52 is installed such that a part of the straight end portion 49 rests in the indent 44 of the notch 43, and the end 54 of the hook portion 52 is inserted into the hole 41 of the fastener plate 34. The top element 27 is then biased downwardly over the upper surfaces of the heat exchanger tubes 12 until the other end 53 clears the lower edge 39 of the fastener plate 33 such that it enters the elongate slot 38 and springs upwardly to lock it into place in a manner similar to that exhibited by a safety pin. The spring tension that remains in the top element 27 then acts to hold that element in its fixed position.

While the present invention has been disclosed with particular reference to a preferred embodiment, the concepts of this invention are readily adaptable to other embodiments, and those skilled in the art may vary the structure thereof without departing from the essential spirit of the present invention.

What is claimed is:

1. An improved support structure for a heater of the type having a heat exchanger with a plurality of parallel tubes over the outer side of which air is caused to flow for transferring heat to the air, wherein the improvement comprises:

a first wire-formed bracket member for extending across one side of the plurality of parallel tubes, said member being secured to a frame member of the heater and functioning to locate and support the tubes in their installed positions; and a second wire-formed bracket member for extending across the other side of the plurality of parallel tubes, said first and second members being connectable on at least one end thereof by the interlocking of a hook member on one bracket member with an open-ended slot on the other bracket member to secure said second bracket member and thereby sandwich said tubes between said first and second bracket members.

2. An improved support structure as set forth in claim 1 wherein said first wire-formed bracket is wavy in form so as to conform to the profile of the plurality of parallel tubes.

3. An improved support structure as set forth in claim 1 wherein said second wire-formed bracket is wavy in form so as to conform to the profile of the plurality of parallel tubes.

4. An improved support structure as set forth in claim 1 wherein said hook member is U-shaped in form.

5. An improved support structure as set forth in claim 1 wherein said first wire formed bracket member includes an open-ended notch formed near each end thereof, and said second wire-formed bracket member includes a hook member on each end thereof, and each of said hook portions are engageable with one of said open-ended notches.

6. An improved support structure as set forth in claim 1 wherein said open-ended slot extends substantially normally to that portion of said other bracket member that extends across said side of parallel tubes.

7. An improved support structure as set forth in claim 1 where said other bracket member includes a plate with said open-ended slot formed therein, and said plate also includes an open-ended notch that extends in a direction substantially normal to said open-ended slot.

8. An improved heat exchanger support apparatus for heaters of the type having plurality of heat exchanger tubes aligned in side-by-side relationship within a chamber through which air is caused by flow for the purpose of heating the air comprising;

a support member extending transversely across, and in direct supporting contact with, one side of said plurality of tubes, with the ends of said support member being supportably connected to a supporting structure in said heater, said support member including open-ended notches formed near either end thereof; and a securing member extending transversely across, and in direct supporting contact with the other side of said plurality of tubes, with the ends of said securing member being connected without fasteners in a spring loaded fashion to associated end portions of said support member so as to spring load said plurality of heat exchanger tubes between said support and securing members, said securing member including a hook near each end thereof; and portions of said respective hooks engaging portions of said open-ended notches.

9. An improved heat exchanger support apparatus as set forth in claim 8 wherein said support member and said securing member are wire-formed structures.

10. An improved heat exchanger support apparatus as set forth in claim 8 wherein said support member and said securing member are wavy in form so as to conform to the profile of the plurality of heat exchanger tubes.

11. An improved heat exchanger support apparatus as set forth in claim 8 wherein said hook portions of said securing member are U-shaped in form.

12. An improved heat exchanger support apparatus as set forth in claim 8 wherein said support member includes a plate on either end thereof, each of said plates having an open-ended notch formed therein and at least one of said plates having an open-ended slot formed therein, said slot being aligned substantially normally to said notch in said at least one plate and being adapted to receive a portion of one of said hooks.

13. An improved heat exchanger support apparatus as set forth in claim 12 wherein the other of said plates has a hole formed therein for receiving a portion of the other of said hooks.

* * * * *